US005307883A

United States Patent [19]

Jenne

[11] Patent Number: 5,307,883

[45] Date of Patent: May 3, 1994

[54] METHOD AND APPARATUS FOR CONTROLLING A RAMMING DEVICE

[75] Inventor: Dietmar Jenne, Strengelbach, Switzerland

[73] Assignee: Terra AG, Strengelbach, Switzerland

[21] Appl. No.: 973,678

[22] Filed: Nov. 9, 1992

Related U.S. Application Data

[62] Division of Ser. No. 664,325, Mar. 4, 1991, Pat. No. 5,198,627.

[30] Foreign Application Priority Data

Mar. 9, 1990 [CH] Switzerland ..... 00774/90-9

[51] Int. Cl.[5] ..... E21B 11/02

[52] U.S. Cl. ..... 175/19; 175/71; 175/92; 173/91

[58] Field of Search ..... 175/6, 19, 65, 92, 296, 175/19, 21, 92; 173/91, 134, 147, 153, 1, 131-133, 210, 91

[56] References Cited

U.S. PATENT DOCUMENTS

| | | | |
|---|---|---|---|
| 3,727,701 | 4/1973 | Sudnishnikov et al. | 173/91 |
| 3,891,036 | 6/1975 | Schmidt | 173/91 |
| 4,221,157 | 9/1980 | Schmidt | 173/91 X |
| 4,537,265 | 8/1985 | Cox et al. | 175/296 X |
| 4,618,007 | 10/1986 | Kayes | 175/296 X |
| 4,953,626 | 9/1990 | Puttmann et al. | 175/19 X |
| 5,050,686 | 9/1991 | Jenne | 173/91 |
| 5,086,848 | 2/1992 | Hudak | 173/91 X |

*Primary Examiner*—Ramon S. Britts
*Assistant Examiner*—Roger J. Schoeppel
*Attorney, Agent, or Firm*—Bachman & LaPointe

[57] ABSTRACT

A method is specified for reversing a compressed air-driven ramming device for its control positions of forward running and rearward running in the earth, wherein, for reversal, a turning is performed against a relatively small detaining force and the force of the operational compressed air is used for locking the control device in the individual control positions and for damping the vibration propagation from a ram housing to the control device. As a result, a reversing of the ramming device during the admission of operational compressed air is reliably prevented.

1 Claim, 5 Drawing Sheets

METHOD AND APPARATUS FOR CONTROLLING A RAMMING DEVICE

This is a division, of U.S. application Ser. No. 664,325 filed Mar. 4, 1991, now U.S. Pat. No. 5,198,627.

The invention relates to a method for locking the control device of a compressed air-driven ramming device into its control positions of forward running and rearward running operation of the ramming device.

PRIOR ART

The control device of a compressed air-driven ramming/boring device has in the case of a prior art machine [DE 38 07 831 - SCHMIDT] a rotation/drawing reversal mechanism which has a fixed control sleeve (24), (See Poton Art FIG. 8), in which an axially fixed bearing tube (14) is supported by means of radial webs (23), there being seated in said tube, likewise axially undisplaceably, a multi-part, preferably two-part control tube (16, 19), which bears at its outer end a compressed air hose, held by a securing clamp (56) engaging radially in a groove. In the case of a two-part control tube (16, 19), its front control tube portion (19) has at its end away from the axially fixed control sleeve (24) a groove-shaped axial recess, into which a single catch lug, which is arranged on the rear, axially displaceable control tube portion (16), engages in an axially insertable manner. The front control tube portion (19) is merely rotatable, whereas the rear control tube portion (16) is rotatable and axially displaceable, for reversal of the direction of percussion. This rear control tube portion (16) is likewise mounted in the fixed bearing tube (14) and defubes with the latter a pressure space (34), which is arranged axially adjoining the (front) end having the catch lug. Adjoining said end in the axial direction there is provided an arresting apparatus (35), which has two positions and is subjected to the pressure prevailing in the pressure space. In this case, the pressure in the pressure space (34) can be applied by a spring (33), by compressed air or by both. For carrying out the reversal, this arresting apparatus (35) must be disengaged against the pressure built up in the pressure space (34). These two positions of the arresting apparatus (35) define two axial positions of the rear control tube portion (16), which for their part correspond to the two reversing positions of the rotary slide valve, formed by the control sleeve (24) and the front control tube portion (19), for the forward running and rearward running of the ramming/boring device. The arresting apparatus (35) has essentially an arresting ring (39), which is connected in a rotationally fixed manner to the rear control tube portion (16) by a key face and possesses two axially extending lugs of different lengths. These lugs engage into - in each-case two of the four corresponding recesses of the rear end face (40) of the bearing tube (14). Due to the different lengths of these lugs, the two switching positions of the arresting apparatus (35) are achieved.

For reversal of the ramming/boring device from forward running to rearward running, after disengaging the rear control tube portion (16) by axial pulling on the compressed air hose, the two-part control tube (15; 16, 19) is turned, by turning at said rear control tube portion through about 90°, either into the first switching position, corresponding to a first stop formed by the first outer edge, or into the second switching position, corresponding to a stop formed by the second outer edge, of a clearance in the bearing tube, and the rotary slide valve control is consequently reversed. With this rotation/drawing reversal mechanism, reversing can be carried out during operation, i.e. under the load of the compressed air.

DISADVANTAGES OF THE PRIOR ART

In the case of this apparatus it is very disadvantageous that a very complicated control device is used which has a rotary slide valve, comprising a plurality of individual parts, and an arresting and rotary slide valve-actuating apparatus, comprising a plurality of individual parts having complicated shapes and mating surfaces Such a highly complicated control device is not only very expensive in production but, which is much more serious, is extremely susceptible to faults and very prone to soiling, in particular in tough construction site operation. Consequently, relatively frequent failures of the ramming/boring device, repair costs and costs for replacement machines or idle times are the consequence. This makes the overall expense of using the machine much more considerable. In addition, it is possible with this apparatus that if a full 90°turn is not made, the rotary slide valve, and consequently the entire control device, assumes an undefined and inoperative position. If engagement happens to occur subsequently, either forward running or rearward running may be activated accidentally. Thus, the control position is dependent upon the machine being operated exactly, which is especially hampered, and sometimes made impossible, by the often very long boreholes, the large axial friction resistance of the compressed air hose used for reversing and dragged on the earth, as well as its torsional weakness in transmission of the rotary movement from one end of the borehole to the other end. In addition, unwanted reversing may take place if the borehole collapses behind the ramming/boring device, as a result of which the circumferential friction occurring between earth and compressed air hose leads to tensile forces on the compressed air hose, which draw the compressed air hose backwards and thereby release the arresting.

OBJECT OF THE INVENTION

It is therefore the object of the invention to provide a control device for a ramming/boring machine which avoids the disadvantages of the prior art machines and, in particular, is of a very simple construction in comparison with the known machines and has components which are less susceptible to faults, the reversal from forward running to rearward running being performed by turning at the compressed air hose alone and consequently being essentially independent of the axial friction force, dependent upon the length of the borehole and in fact very considerable, which the axial pulling at the compressed air hose for disengaging and reversal, which is necessary in particular at the end of the borehole. Also, the control device is to remain reliably locked even in the event of a collapsed borehole. In addition, even in the event of a collapse of the borehole and the very great axial tensile forces occurring in this case on the compressed air hose, the control device should not be disengaged and consequently reversed, or go into an undefined operating state which necessitates manual salvaging of the ramming/boring device or even hinders said salvaging. What is more, the ramming/boring device is to be provided with a damping mechanism which comes into effect even at high operating pressures of the compressed air or improves said damping. This is in contrast to prior art damping devices, with which the damping becomes poorer with increasing operating pressure.

METHOD

In the method for reversing a compressed air-driven ramming device for its control positions of forward running and rearward running in the earth, a returning movements within the ramming device and a control device controlling all these movements in interaction with the percussion piston, the reversal is performed by a turning of the control device against a first predeterminable force with the operational compressed air switched off, there then takes place an exact positioning of the control device on account of this force and independently of the turning movement and a following locking of the control device is performed in the individual control positions by a second force, which is essentially independent of the first force in terms of effectiveness, can likewise be predetermined by design measures and operational data and also undertakes the damping of the vibration propagation from the ram housing to the control device and thereby reliably prevents a reversing of the ramming device during the admission of operational compressed air.

In a reversal of the ramming device from forward running to rearward running, the compressed air hose is turned, the compressed air being interrupted. After executing the turning movement, the compressed air is switched on again and, as a result, the switching position which is now the position for the rearward running of the ramming/boring device, is locked.

APPARATUS

Further details and advantages of the invention emerge from the description of exemplary embodiments with reference to the drawing, in which.

Figure 1:
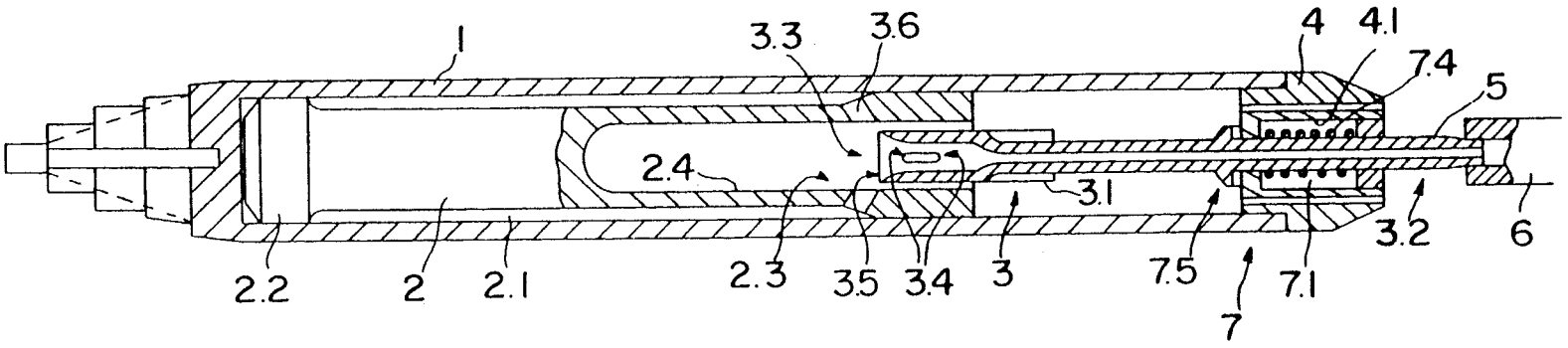
FIG. 1 shows a ramming/boring device in longitudinal section [without turning limiter]
Figure 2:
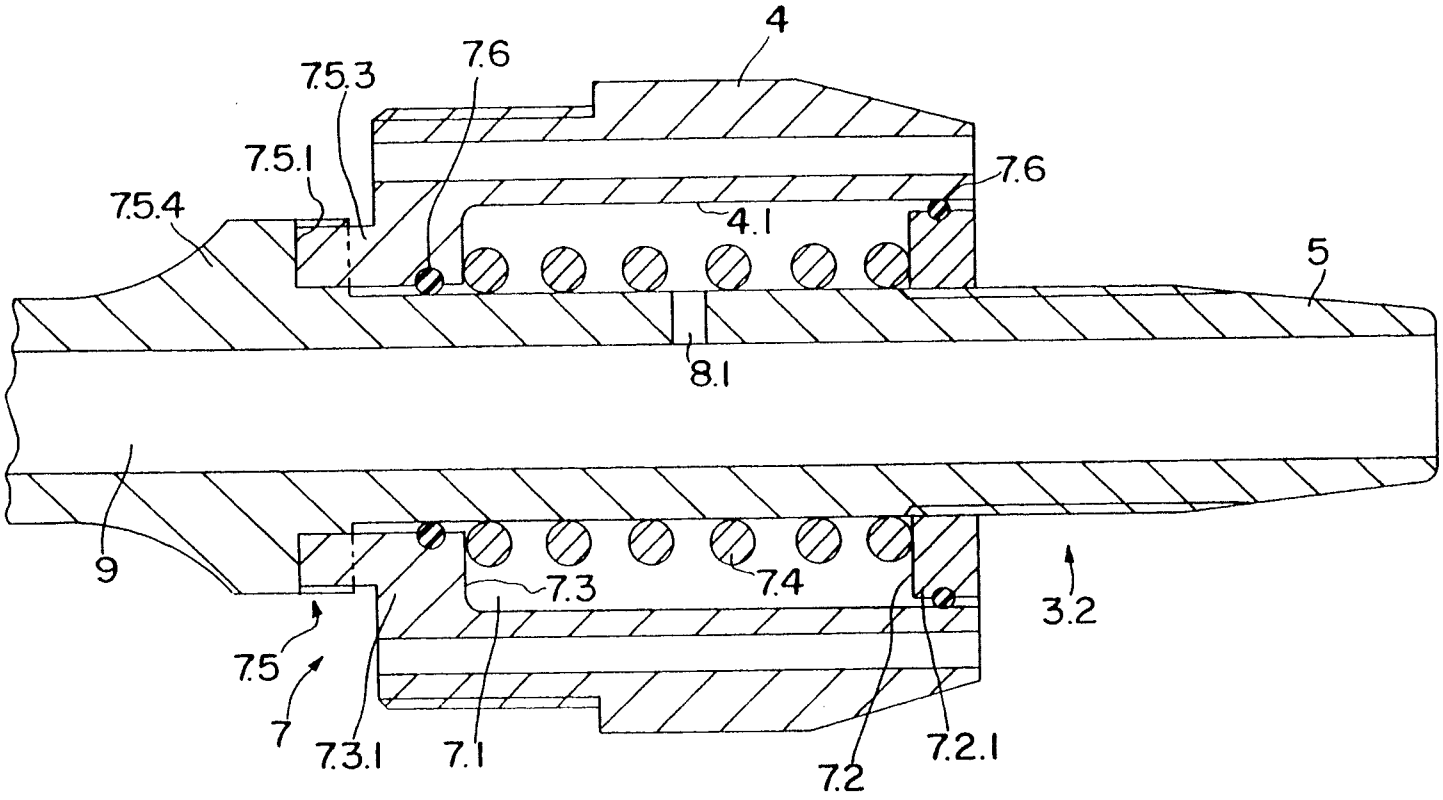
FIG. 2 shows a detail of the control device in longitudinal section [without turning limiter]

A ramming device has a ram housing 1, in which a partially tubular percussion piston 2 is arranged longitudinally displaceably. Between the latter and the housing 1 there is situated along the convex surface of the percussion piston an annular space 2.1, through which air can flow to the percussion piston tip 2.2. One end of the ram housing 1 is closed by a removable cover 4, in which a control device 3 is seated, the one [outer] end 3.2 of the latter protruding outward and having a hose connection 5 for a compressed air hose to the compressed air supply line. Another [inner] end 3.3 protrudes into the rear region 2.3 of the percussion piston 2 and slides along its inner convex surface 2.4. This inner end 3.3 of the control device 3 has control edges 3.4 and 3.5 and control channels, for example as shown in DE 38 00 408 -TERRA, which interact with corresponding control openings 3.6 of the percussion piston and control the advancing and returning movement of the latter in the ram housing 1. The control device 3, which is essentially of a one-part design, has a central bore 9 (FIG. 2), which extends over its entire length and opens out at the outer end 3.2 of the control device 3 into the hose connection 5. In the region of its outer end 3.2, it is connected to an arresting and damping device 7, arranged in the cover 4.

Figure 3:
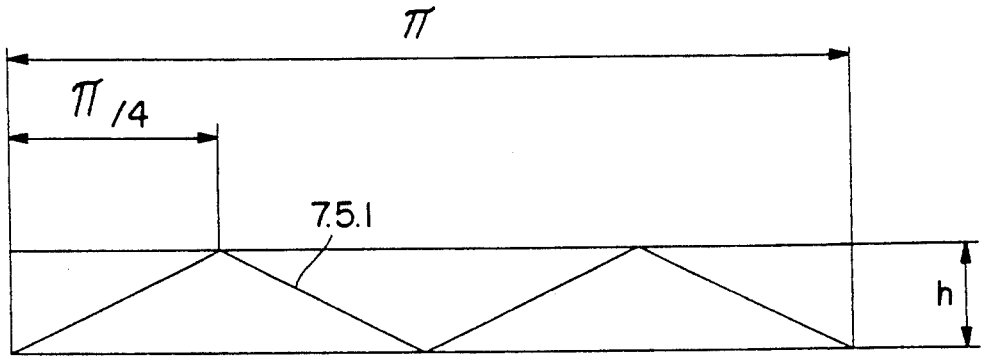
FIG. 3 shows a first variant of a spur gearing.
Figure 4:
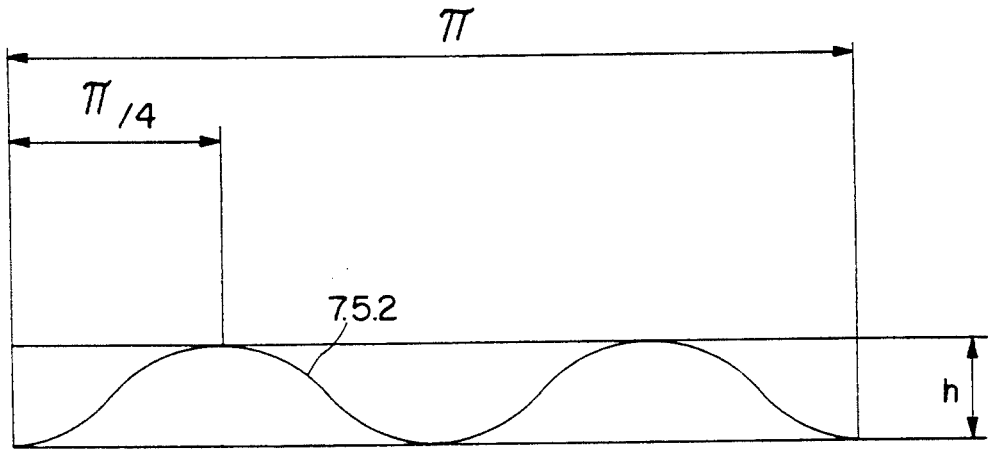
FIG. 4 shows a second variant of a spur gearing.
Figure 5:
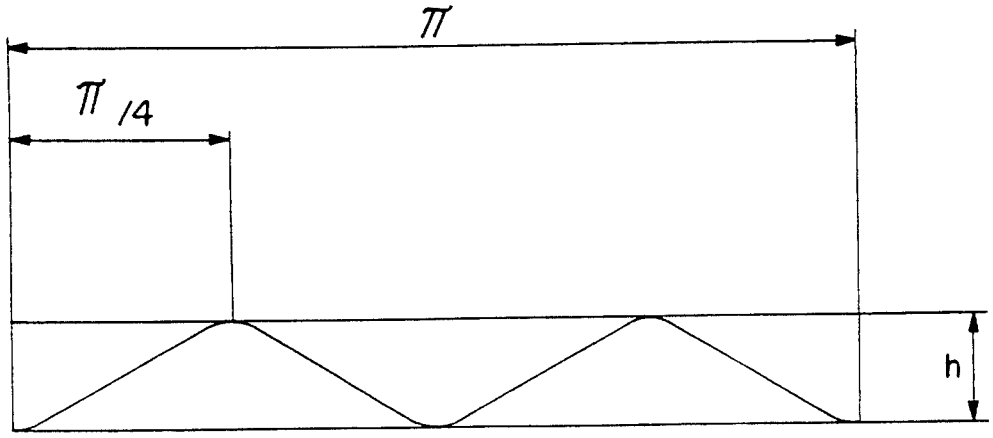
FIG. 5 shows a third variant of a spur gearing.

The arresting and damping device 7 has an air chamber 7.1, variable in its size, which is arranged essentially axially parallel to the control device 3. The air chamber 7.1 possesses end walls 7.2, 7.3, which are axially displaceable with respect to each other, a first end wall 7.2 being connected to the control device 3 and a second end wall 7.3 being connected to the cover 4 or the ram housing 1. The first end wall 7.2 is essentially part of a rear terminating ring 7.2.1, connected to the control device 3 in a firm and adjustable as well as releasable manner. On its circumferential side, it bears with a sealing element 7.6 of a conventional type, for example an 0-ring, against a cylinder-like inner surface 4.1 of the cover 4 and can be displaced along the latter by the control device 3. The second end wall 7.3 of the air chamber 7.1 is formed by a front terminating ring 7.3.1, which is firmly connected to the cover 4 and relatively displaceable alongside this cylinder-like inner surface 4.1 and against the rear terminating ring 7.2.1. As the other axial wall of the air chamber 7.1, a region of the outer convex surface 3.1 of the control device 3 is used. Between these end walls 7.2 and 7.3 there is seated at least one energy accumulating element 7.4, pressing said walls apart. One embodiment of such an energy accumulating element is a helical spring. However, some other resilient element may also be used. The air chamber 7.1 is connected by a connecting line to a space 9 containing the compressed air, which in the present case is a central bore 9 in the control device 3, and can be filled with compressed air or emptied by said space. If this connecting line is designed as a connecting bore 8.1, the response time of the locking function can be influenced and defined by its dimensions. The helical spring or the resilient element in this case provides the positioning force for a positioning device 7.5 and the compressed air in the air chamber 7.1 provides the locking force. In addition, this compressed air acts as a damping element, which damps the usually very hard impacts of the ram housing 1 uniformly and not with a force dependent on the vibration excursion of the control device 3 with respect to the cover 4, and the impacts are thus not passed on to the control device 3. In this case the damping becomes better with increasing operational pressure of the compressed air. This is in contrast to a prior art damping device with resilient damping elements A positioning device 7.5 is provided for the interaction of control device 3 and arresting and damping device 7. This positioning device 7.5 has on the one hand a detaining flange 7.5.1 on the front terminating ring 7.3.1 and on the other hand a detaining flange 7.5.4 connected to the control device 3 and designed as a counterpart to the detaining ring 7.5.3, both being able to bear flush against each other. Their contact surfaces are each designed as a matching normal (FIG. 3) or wave-shaped spur gearing (7.5.2.) (FIG. 4). However, a special spur gearing may also be provided [FIG. 5], which has essentially plane flank surfaces, the head edges of which are rounded-off, in order to facilitate the reversing operation. In the case of each of these spur gearing forms, each of the flanks, both on the detaining ring 7.5.3 and on the detaining flange 7.5.4, is arranged in a central angle range of 10°–45°, preferably in a range of 20°–25°. In other words, a flank extends in an angle range of 10–45 or 20–25 degrees. The flanks within each pair of flanks in the case of each of the spur gearings (7.5.1 and 7.5.2, respectively) can in this case have an identical or different absolute value of the flank lead, corresponding flanks of the detaining ring 7.5.3 or of the detaining flange 7.5.4 of course having to have a mutually corresponding lead.

Figure 6:
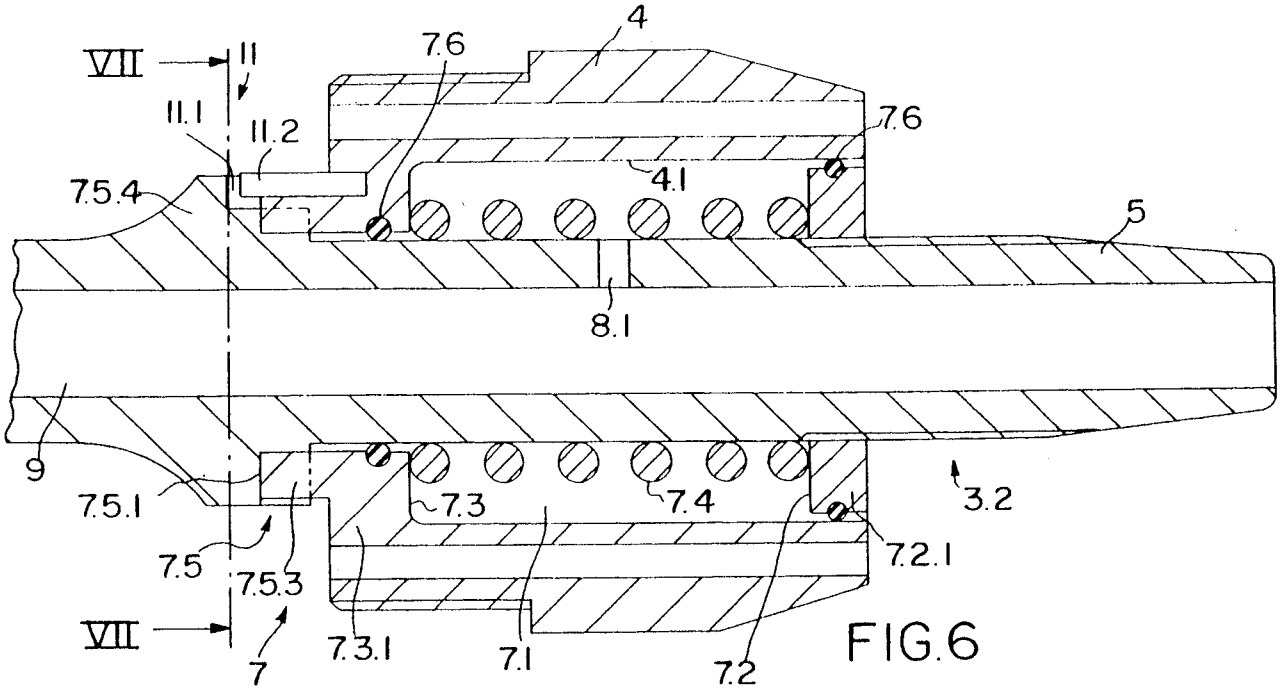
FIG. 6 shows a longitudinal section through the control device in the region of the turning limiter.
Figure 7:
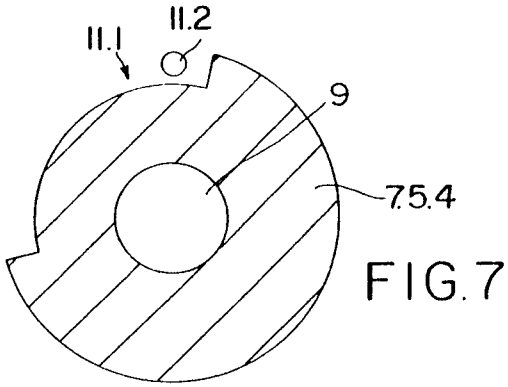
FIG. 7 shows a cross section through the control device in the region of the turning limiter.
Figure 8:
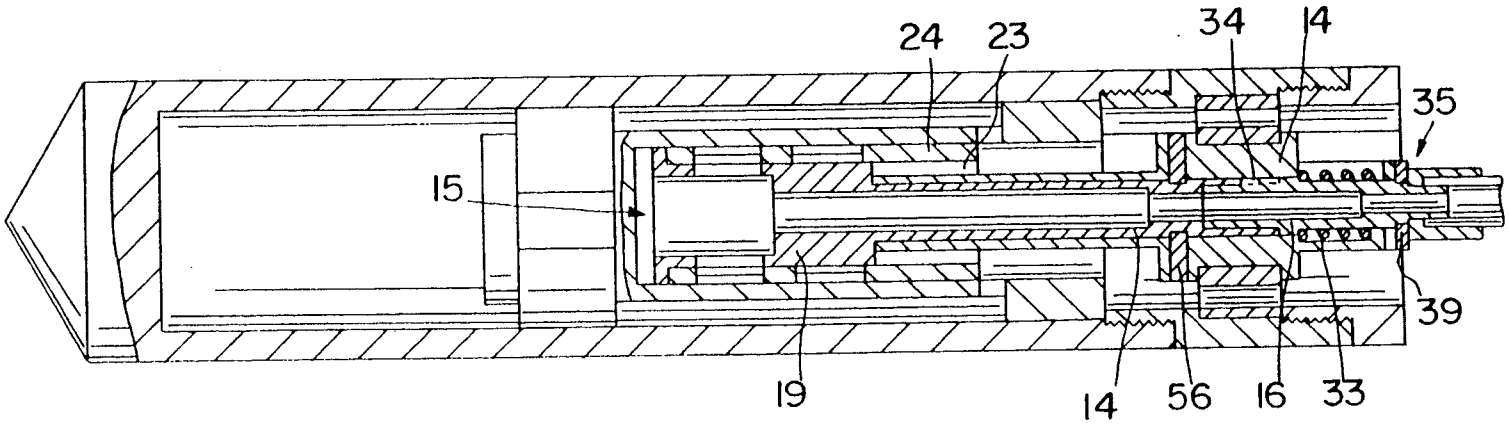
FIG. 8 PRIOR ART
FIG. 8 shows a prior art control for a compressed air-driven ramming/boring device.

In a design variant of the invention, the positioning device 7.5 (FIG. 6) may have a turning limiter 11, said limiter containing a groove 11.1 which is arranged on the geometrical convex surface of the detaining flange and in which a pin 11.2 engages, which protrudes from the second end face 7.3 above the detaining ring 7.5.3. The groove 11.1 extends over a sector of the circumference which is somewhat greater than a quarter turn, preferably 110°, so that in the turning of the control device necessary for ram reversal, by turning at the compressed air hose, the new control position can initially be overshot by a small amount.

MODE OF OPERATION

Positioning Function

In one control position, let us assume forward running of the ramming device, the control device 3 is engaged in a first position of the positioning device 7.5 on account of the force of the spring 7.4 in the air chamber 7.1. The compressed air passes on the one hand through the central bore 9 to the control device 3 and consequently drives the percussion piston and on the other hand through the connecting bore 8.1 into the air chamber 7.1 and keeps the control device 3 in the locked state.

Upon a reversal of the ramming device from forward running to rearward running, the compressed air hose is turned, for example through about 90°, the compressed air being interrupted by a shut-off cock, which is located at the excavation end of the compressed air hose. This shut-off cock is preferably a three-way cock, which interrupts the supply of further compressed air and at the same time permits the discharge of the compressed air in the hose. As a result, the reversing turning of the control device 3 is only performed against the force of the spring 7.4. On account of the small displacement excursion, the force is virtually constant and can be chosen when designing the device such that optimum setting and operability can be ensured under all operating circumstances. In particular, this coordination during design can be carried out to achieve best operability in interaction with the flank angle and the form of the spur gearing. After executing the turning movement, the compressed air is again switched on and, as a result, the switching position, which is now the position for the rearward running of the ramming/boring device, is fixed.

If the positioning device 7.5 has a turning limiter 11, the execution of the turning movement is easier, because then it is only necessary to turn as far as the limiter and attention does not have to be paid to when the positioning device 7.5 engages. This is particularly of essential advantage in the case of tough construction site operation.

Damping Function

The impacts of the percussion piston 2 against the ram housing 1 and the connection of the latter to the control device 3, seated in the cover 4 always with a play necessary for the turning movement for reversal, cause said control device to vibrate. Such vibrations may come to lie in particular in the proximity of the resonant ranges and then lead to rupture damage, usually on the control device. On the one hand, on account of the operating pressure in the air chamber 7.1, the two detaining elements, namely the detaining ring and the detaining flange 7.5.3 and 7.5.1, respectively, of the positioning device 7.5 are pressed against each other without any play, so that the vibrations occurring on account of the abovementioned axial play which always exists in the case of prior art machines cannot occur at all in the case of the subject of the invention due to the absence of this axial play. On the other hand, the air chamber as damping element, with the compressed air as damping medium, has a constant spring characteristic value which is virtually uninfluenced by a possible vibration amplitude on account of the relative sizes. This is in contrast to conventional resilient damping elements. By these though a vibration is damped amplitude-independently. In addition, this damping force can easily be adapted at any time to temporary conditions by altering the operating pressure, even during operation.

Another variant [not shown in the figures] of an arresting and damping device 7 has at least one air chamber 7.1, likewise variable in its size, which is likewise arranged essentially axially parallel to the control device 3, but not co-axially. Preferably, two or more such air chambers are provided. Their construction and their mode of operation correspond essentially to that of the co-axial air chamber. Also, the connection to a positioning device (7.5) which is set up for interacting on the one hand with a component corresponding to the front terminating ring (7.3.1) and on the other hand with the control device (3) and fixes each of the control positions by locking the control device with respect to the cover, corresponds functionally to the first variant described above.

For damping the vibration propagation from the ram housing (1) to the control device (3), the compressed air in at least one of the air chambers (7.1) is provided and used as energy accumulating element and as damping element and, just like the connecting bore, these air chambers are appropriately designed for this function in terms of their dimensions.

The advantage of such a multiple air chamber lies in the increase in reliability during operation, because, in the event of possible failure of one air chamber due to soiling etc., operational reliability is still ensured by the other air chambers.

Advantages

Such a damping device which is independent of a progressive spring excursion, i.e. of the vibration excursion/vibration amplitude, is particularly advantageous because, as a result, the damping of the control device with respect to the ram housing is improved by orders of magnitude. This has the consequence that the control edges of the control device always lie geometrically at the correct place, that is to say the control of the percussion piston movement can be performed much more exactly. This causes a significant reduction in the resonance states of the ramming/boring device and of the control device, with the effect that the control device ruptures much less than with other damping devices.

Such vibrations of the control device with respect to the ram housing can only be damped and not eliminated entirely, since the control device always has a small axial play owing to the necessary turning for the switching from one control position into another. This play is generally of the order of magnitude of 0.1 mm. This is sufficient however to allow enormous percussion force peaks to occur on account of the undamped vibrations. With the vibration damping according to the application, these vibrational forces are drastically reduced.

In addition the damping becomes all the better the higher the operating pressure of the compressed air used for damping. Consequently, in using the operational compressed air for damping it is possible to achieve on the one hand with the increase in the pressure itself a higher machine power and on the other hand an improvement in the damping. This is in contrast to the prior art machines, with which a higher machine power was always gained at the expense of higher vibration stress and consequently usually earlier rupture of a machine part, generally the control device.

A further advantage arises from the fact that by using compressed air to provide the locking force, this locking force is no longer applied when the compressed air supply is switched off, that is to say during the reversing operation, so effortless reversing of the machine is made possible, since the turning only has to be executed against the detaining force of the spring and the locking force does not have to be overcome as well. This permits a very high locking force which, even in the event of a collapsed borehole, does not cause reversing of the ramming/boring device or an undefined control position, and thus stranding of the ramming/boring device in the borehole. Consequently, time-consuming and expensive salvaging work for a ramming/boring device stuck in the borehole is also avoided.

I claim:

1. A method for reversing a compressed air-driven ramming device between forward running and rearward running operation, the ramming device comprising a ram housing, a piston movable forth and back inside said housing and a control device mechanically connected to a supply means for supplying compressed air to the control device which is rotatable between a first angular position and a second angular position corresponding to the forward running and the rearward running operation, respectively, of the ramming device, the two angular positions being axially identical, the method comprising the steps of:

(a) switching off the supply of compressed air to said control device so that said control device is held in position by a nominal detaining force;

(b) rotating said control device from one of said first and second positions to the other one of said first and second positions by rotating said supply means against said nominal detaining force, said control device being axially moved forth and back during its rotation from said one position to said other position; and (c) switching on said supply of compressed air to said control deice, whereby operation of said machine is resumed, operating vibrations of said ramming device are damped by said compressed air, and said control device is reliably locked by said compressed air into said other one of said positions so as to prevent reversing of said ramming device during operation.

* * * * *